United States Patent [19]

Kettle

[11] Patent Number: 4,900,595

[45] Date of Patent: Feb. 13, 1990

[54] PRECIOUS PEBBLE VASE

[76] Inventor: Colleen K. Kettle, 19755 Highway 550, Montrose, Colo. 81401

[21] Appl. No.: 344,808

[22] Filed: Apr. 28, 1989

[51] Int. Cl.[4] ..... B65D 23/10

[52] U.S. Cl. ..... 428/34.4; D11/104; 206/457; 428/3

[58] Field of Search ..... D11/104, 148, 149, 150; 206/457; 428/3, 7, 13, 16, 34.1, 34.4, 35.7, 542.2, 542.4

[56] References Cited

U.S. PATENT DOCUMENTS

| | | | |
|---|---|---|---|
| D. 158,699 | 5/1950 | Wasilevich | 428/542.4 X |
| D. 163,866 | 7/1951 | Halpert | D11/149 X |
| D. 166,445 | 4/1952 | Conover | D11/150 |
| D. 166,447 | 4/1952 | Conover | D11/150 |
| D. 166,450 | 4/1952 | Conover | D11/150 |
| D. 235,784 | 7/1975 | Maloy | D11/150 X |
| D. 280,715 | 9/1985 | Heap | 428/34.1 X |
| 1,714,193 | 5/1929 | Slick | 428/34.4 X |
| 3,144,932 | 8/1964 | Zerbo, Jr. | 428/24 X |
| 4,065,016 | 12/1977 | Perkins | 428/34.1 X |
| 4,143,204 | 3/1979 | Frang | 428/413 |
| 4,378,215 | 3/1983 | Sparks | 428/13 X |
| 4,454,204 | 6/1984 | Posey | 428/542.4 |
| 4,540,378 | 9/1985 | Cusimano | 446/369 |
| 4,654,274 | 3/1987 | DeMars | 428/16 X |
| 4,791,030 | 12/1988 | DeMars | 428/16 X |

*Primary Examiner*—Henry F. Epstein

[57] ABSTRACT

A precious pebbles vase comprising a base which supports a pair of hands for holding a transparent, hollow vessel adapted to receive and hold a plurality of pebbles. A small pebble is placed in the vessel each time a good deed or act is performed by the owner of the vase.

10 Claims, 1 Drawing Sheet

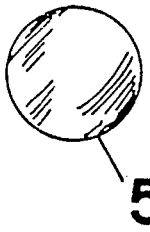
FIG. 1
FIG. 2
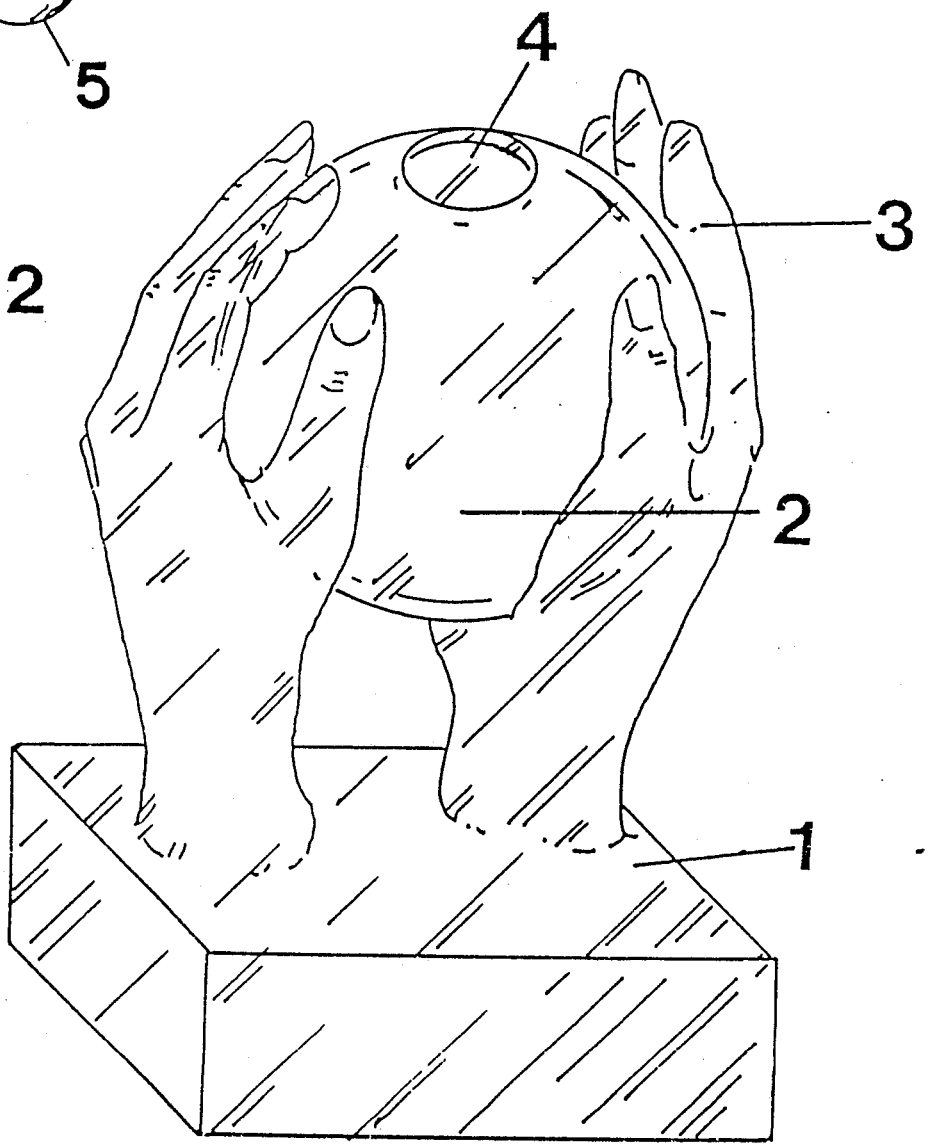

PRECIOUS PEBBLE VASE

RELATED APPLICATION

Ser. No. 07/064,760, filed June 22, 1987, now abandoned.

BACKGROUND OF THE INVENTION

The invention relates generally to a new design of a vase which will relieve stress and is a source of beautification and gratification in improving one's self image.

SUMMARY OF THE INVENTION

The invention relates to a vase that can be filled with a round like pebble or other symbolic object.

The pebble represents an image of a "good deed"performed by the person who owns the vase.

It is an object of the invention to provide a gift to oneself by placing a pebble into the vase each time you have done a good deed or act for someone or yourself. To make it effective, whenever the owner of the vase becomes down on oneself because they have made a mistake or did not do something right or something has happened in their lIfe that they do not feel good about, they can turn to their vase and meditate. It mentally will give a relief of stress when they can take a short moment to remind themselves of all of the good they have done by seeing all of the pebbles that have accumulated inside the vase.

It is another object of the present invention to find extraordinary in oneself through a unique vase filled with small pebbles. By filling the vase in this manner, it will change an ordinary to bad day into a more peaceful and meaningful day for yourself and all that are around you.

It is a further object of the invention to provide means to watch ourselves honestly so that we can see that often we are own worst enemy in almost every situation. To remind ourselves that one of the worst things in life is to try and please but please not, especially, ourselves. The unique vase and pebble concept will remind us that we are full of self good and by reminding ourselves of this we can find inner peace to give to ourselves and people who are around us.

BRIEF DESCRIPTION OF THE DRAWING

FIG. 1 is a side elevational view of a round like pebble and

FIG. 2 is a perspective view of a precious pebbles vase in accordance with my invention.

DETAILED DESCRIPTION OF THE INVENTION

Referring to Figure, a preferred embodiment of the precious pebbles vase is shown. In this embodiment, the precious pebble vase is comprised of a square crystal base 1 and an attached pair of vertically disposed crystal hands 3 which securely hold a transparent, hollow, crystal vessel 2. The hollow vessel 2 has an opening 4 at the top center as a means for the user to place the round pebble 5 shown in FIG. 1 inside of the ball-shaped vessel 2 each time a good deed is performed.

In the preferred embodiment of my invention, the support base, hands, hollow vessel and pebble are made of crystal glass. The base, hands and pebble are preferably solid; however, one or all components can be hollow. A lower grade of glass can be used for any of the components 1, 2, 3 and 5. In order to achieve the functions of my invention which includes enabling the user to view the accumulation of the pebbles inside the vessel, it is important that the walls of the vessel be sufficiently transparent to permit the user to see the pebbles. The vessel is preferably clear and colorless; however, it can be various gradations of color such as a rose-hued, yellow-hued or the like that does not prevent seeing the pebbles. In lieu of opening 4 positioned at the top center of the vessel, the opening can be positioned at about mid-point or higher of the vessel side wall. Also, the size of the opening 4 can be increased so as to enable the user to reach her or his hand into the vessel. The vessel can be made of colored or clear and transparent glass or plastic.

The base 1 in the preferred embodiment is solid and square in order to provide good stability for the vase. Stability can be achieved using numerous other shapes, solid or hollow, such as rectangular, triangular, oval, circular, diamond, or the like. Suitable materials for the base include glass, plastic, wood, stone and various ceramic materials. The support base component can be clear and transparent, semi-transparent or opaque of various colors.

The hands 3 of the vase which support and hold the transparent, hollow vessel 2 in the preferred embodiment are vertically aligned(longitudinal) and the wrist portion resting on and secured to the top surface of the base support 1. The hands can be connected to the base as by gluing, screw or bolt, or making, such as by molding, the hands and support base as a single, integral piece. The hands can be made of the same materials as described for the base or different materials. Similarly, the hands can be clear and transparent, semi-transparent or opaque of various colors. In another embodiment of the vase of the present invention, not shown, the hands are laterally aligned and substantially parallel to the top surface of the base. The outer edge of the hand in this embodiment rest on and is connected to the top surface of the base with the fingers extending and holding the hollow vessel latitudinally.

The term "hollow vessel", as used herein and the appended claims, means vessels of various shapes such as ball(oval or round), cylindrical, square, rectangular shape, or the like.

The term "transparent", as used herein and the appended claims, means clear and transparent, as well as, semi-transparent.

The term "pebble", as used herein and the appended claims, means a spheroid shaped pebble as shown in FIG. 1 and includes polygonal shapes such as cubes, hexagonal, octagonal, or the like.

What is claimed is:

1. A precious pebble vase for the holding of and viewing of pebbles which comprises:

a stable support base;

a transparent, hollow vessel adapted for the reception of or removal of one or more pebbles; and a pair of hands connected to the support base and adapted to securely hold the vessel.

2. The vase of claim 1 wherein the vessel is a clear and transparent glass or plastic.

3. The vase of claim 1 wherein the vessel is a colored and transparent glass or plastic.

4. The vase of claim 1 wherein the vessel is a clear, crystal glass.

5. The vase of claim 1 wherein the hands are longitudinally aligned with the vessel.

6. The vase of claim 1 wherein the base, vessel and hands are made of clear, crystal glass.

7. The vase of claim 1 wherein the vessel is in the shape of a ball.

8. The vase of claim 6 wherein the vessel is in the shape of a ball, the base is square shaped, and the hands are longitudinally aligned with the vessel.

9. The vase of claim 1 wherein the hands are latitudinally aligned with the vessel.

10. A precious pebble vase for the holding of and receiving of pebbles which comprises:

a stable support base which is square or rectangular in shape;

a transparent, hollow vessel in the shape of a ball adapted for the reception of or removal of one or more pebbles; and a pair of hands connected to the support base and adapted to securely hold the vessel, said hands being longitudinally aligned with the vessel.

* * * * *